US005911594A

United States Patent [19]

Baker, III et al.

[11] Patent Number: 5,911,594

[45] Date of Patent: Jun. 15, 1999

[54] CONNECTOR WITH WIRE GUIDE

[75] Inventors: Frank P. Baker, III, Chatham, N.J.; Lyndon D. Ensz, Douglas, Nebr.; Amid I. Hashim, Randolph, N.J.; William J. Ivan, Woodbridge, N.J.; Troy P. Million, Sparta, N.J.

[73] Assignee: Lucent Technologies Inc., Murray Hill, N.J.

[21] Appl. No.: 08/922,943

[22] Filed: Sep. 3, 1997

[51] Int. Cl.[6] ..... H01R 4/24

[52] U.S. Cl. ..... 439/404

[58] Field of Search ..... 439/404, 941, 439/417

[56] References Cited

U.S. PATENT DOCUMENTS

| | | | |
|---|---|---|---|
| 4,009,921 | 3/1977 | Narozny | 439/404 |
| 5,460,545 | 10/1995 | Siemon | 439/404 |
| 5,601,447 | 2/1997 | Reed | 439/404 |
| 5,681,180 | 10/1997 | Rodrigues | 439/404 |

*Primary Examiner*—Steven L. Stephan
*Assistant Examiner*—Javaid Nasri

[57] ABSTRACT

Connectors, such as 110-type patch plugs, are designed to reduce near-end crosstalk that is generated between the twisted pairs of multi-wire cordage. Connectors of the present invention have a wire guide having a plurality of channels within which the different twisted pairs and ultimately the individual wires are distributed from the cordage to corresponding conducting contacts of the connectors. The channels of the wire guide enable improved control over the twist rates of the different twisted pairs as well as the routing paths between the cordage and the contacts which reduces the level of near-end crosstalk as well as variability in that level from one connector assembly to another. In one particular embodiment, the connector has a four-piece modular design (not counting the individual contacts) having separate wire guide, contact base, top cover, and bottom cover. The contact base receives the conducting contacts and mounts onto the wire guide to form the electrical connections between the contacts and the individual wires.

14 Claims, 10 Drawing Sheets

CONNECTOR WITH WIRE GUIDE

This application is related to U.S. patent application Ser. No. 08/858,234, filed May 19, 1997 as Baker 4-6-8-6, and to U.S. patent application Ser. No. 08/923,741, filed Sep. 2, 1997 as Adriaenssens 3-7-4-11-6, the teachings of both of which are incorporated herein by reference.

BACKGROUND OF THE INVENTION

1. Field of the Invention

The present invention relates to electrical connectors, and, in particular, to plugs designed to reduce crosstalk between adjacent transmission paths.

2. Description of the Related Art

One type of plug used to terminate cordage (i.e., multi-wire cabling) is the 110-type patch plug, manufactured by Lucent Technologies, Inc., of Murray Hill, N.J. One end of the 110-type patch plug permanently terminates a multi-wire cable, while the other end mates removably to the insulation displacement contacts (IDCs) of a 110-type connecting block, which is also manufactured by Lucent Technologies. 110-type patch plugs are often used in voice and data transmission applications. In such transmissions, a balanced signal transmission path is formed by each pair of conductors, called the TIP conductor and the RING conductor. A typical 8-wire cable can therefore support four different voice or data signal transmission paths.

A 110-type patch plug has one or more pairs of contacts (typically 1, 2, 3, or 4 pairs) that form the electrical connections between the conductors of a multi-wire cable and the IDCs of a 110-type connecting block. One end (i.e., the mating end) of each patch-plug contact is a blade that engages a split-beam contact of the 110-type connecting block. The other end (i.e., the cable end) of each patch-plug contact has a split-beam contact (e.g., an IDC) that terminates one of the cable conductors. The blades are sequenced in a linear alternating fashion between TIP and RING conductors in order to be aligned with the split-beam contacts of a 110-type connecting block.

FIG. 1 shows an exploded view of a prior-art 110-type patch plug 100. 110-type patch plug 100 of FIG. 1 has a bottom cover 102, a top cover 104, and four pairs of contacts 106, with each TIP-RING pair ($T_i$, $R_i$) corresponding to a single balanced transmission path. When housed within bottom cover 102, each contact 106 provides, at one end, a blade for mating with a split-beam contact of a 110-type connecting block and, at the other end, an insulation displacing contact (IDC) 110 for terminating a wire of a multi-wire cable. Depending on the particular embodiment, one or more TIP-RING pairs of contacts 106 may be designed to cross over one another, as shown in FIG. 1.

As shown in FIG. 1, contacts 106 are designed such that the open ends of IDCs 110, which receive the individual cable wires, face top cover 104. Top cover 104 has structural components that force the cable wires into the corresponding IDCs 110, thus ensuring good electrical contact between the cable wires and contacts 106 of patch plug 100 when top cover 104 is assembled onto bottom cover 102.

One common type of conventional multi-wire cabling used for telecommunications applications has one or more twisted pairs of copper wires, where each twisted pair carries the TIP and RING signals for one balanced transmission path. In order to reduce crosstalk between these transmission paths, a different twist rate is used for each different twisted pair within such cordage. A twist rate may be characterized in terms of the number of times the wires of a twisted pair circle one another over a particular length of cordage, e.g., in terms of revolutions per foot.

Near-end crosstalk refers to unwanted signals induced in one transmission path due to signals that are transmitted over one or more other transmission paths appearing at the end nearest to where the transmitted signals are injected. Near-end crosstalk often occurs when the wires, contacts, and/or other conductors that form the various transmission paths are in close proximity to one another. The twist rates for cordage for telecommunications applications is typically carefully selected and strictly maintained within the cordage to limit such near-end crosstalk.

As shown in FIG. 1, prior-art patch plugs have a volume 112 within which the twisted pairs and ultimately the individual wires are distributed from a multi-wire cable to the IDCs 110 of an 110-type patch plug. Lack of control over twist rates within volume 112 may lead to near-end crosstalk. Moreover, lack of control over routing paths within volume 112 may result in the levels of such crosstalk varying significantly from one patch plug/cordage assembly to another, due to variations in those routing paths from assembly to assembly. The resulting electrical/transmission performance variability may be intolerable for certain high-performance, high-speed telecommunications systems.

SUMMARY OF THE INVENTION

The present invention is directed to connectors, such as 110-type patch plugs, that are designed to reduce near-end crosstalk that is generated when the connector is used to terminate cordage having two or more twisted pairs. According to the present invention, the connector has a wire guide having channels through which the different twisted pairs and ultimately the individual wires are routed from the cordage to, for example, the insulation displacing contacts of the connector. The channels of the wire guide help to maintain the appropriate twist rates for the different twisted pairs as well as helping to control the routing paths for the different twisted pairs and individual wires. Since the twist rates are maintained more accurately than in the prior art, the level of crosstalk induced during the distribution of wires from cordage to IDCs is reduced. Moreover, since the routing paths are better controlled, variations in crosstalk from one connector/cordage assembly to another are also reduced.

In one particular embodiment of the present invention, a patch plug assembly has a four-piece modular design, not counting the individual conducting contacts. The four-piece assembly comprises a contact base for retaining the conducting contacts of the patch plug, a wire guide for distributing the twisted pairs and individual wires from a multi-wire cable to the appropriate contacts, and top and bottom covers. The electrical connections between the individual wires and the contacts are made when the contact base is mounted onto the wire guide.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

FIGS. 2–11 show a preferred process for assembling a patch plug, according to one embodiment of the present invention, onto a length of cordage having four twisted pairs.

Figure 1:
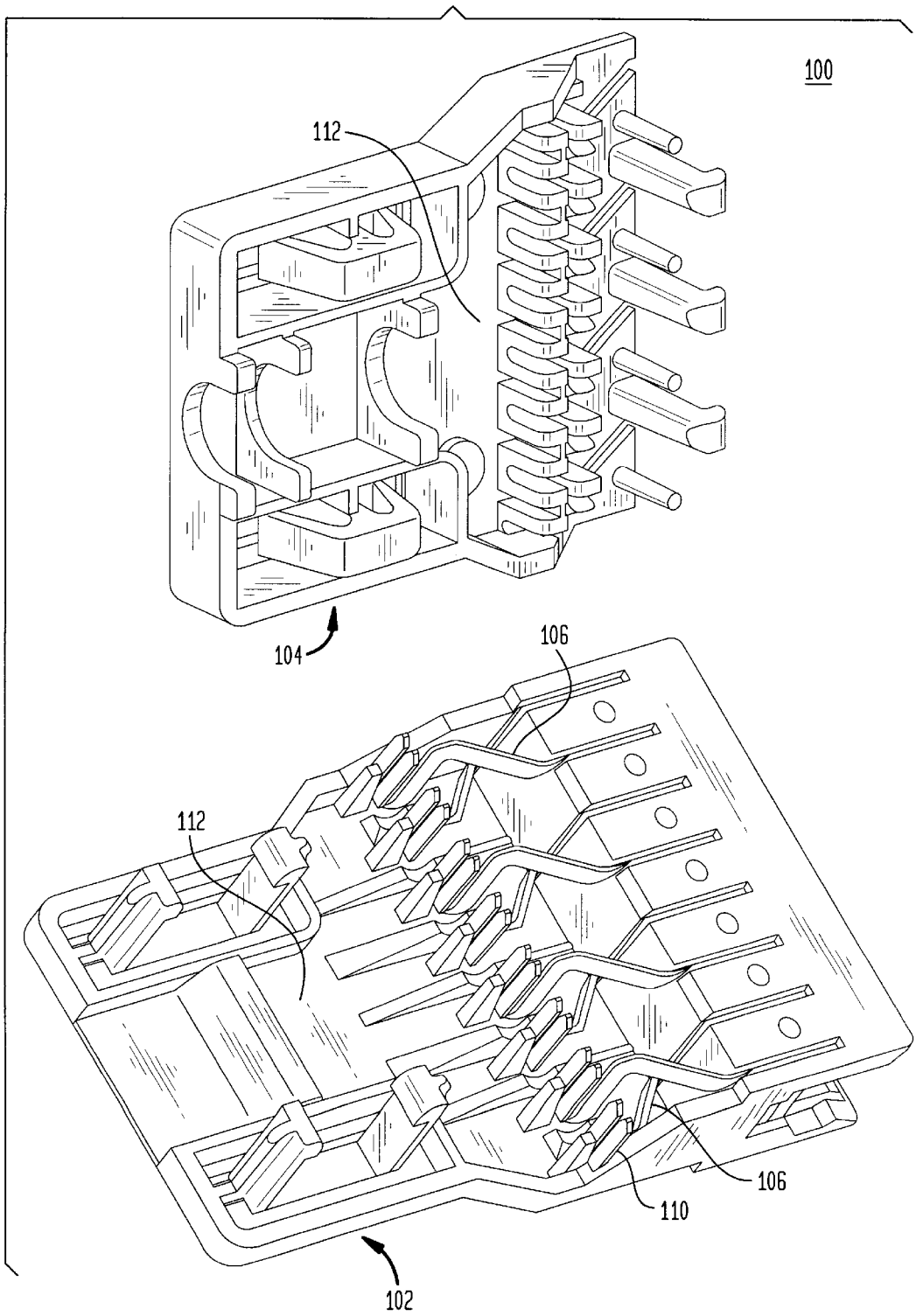
FIG. 1 (PRIOR ART)
FIG. 1 shows an exploded view of a prior-art 110-type patch plug.
Figure 2:
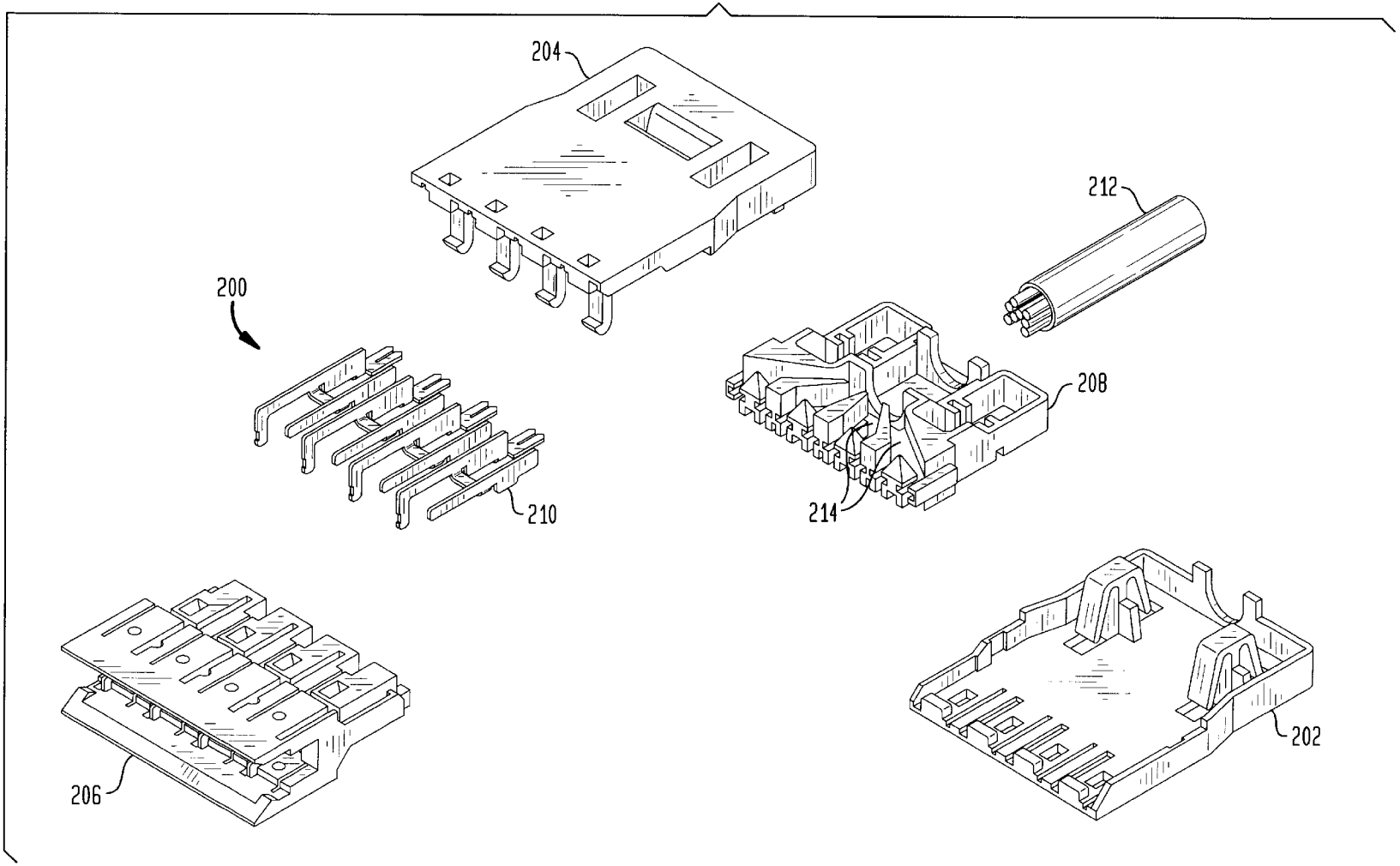
FIG. 2 shows an exploded view of a patch plug and cordage, according to one embodiment of the present invention.

FIG. 2 shows an exploded view of patch plug 200 and cordage 212 before assembly. Patch plug 200 comprises a bottom cover 202, a top cover 204, a contact base 206, a wire guide 208, and four pairs of contacts 210 (only four of which—the four top contacts—are shown in FIG. 2). Wire guide 208 has channels 214 for receiving the twisted pairs and individual wires of cordage 212. Covers 202 and 204, base 206, and guide 208 are preferably made from a non-conducting injection-molded plastic, such as polycarbonate, ABS, or PVC, while contacts 210 are made from a conducting material, such as stamped phosphor bronze plated with nickel and gold. Patch plug 200 is designed to terminate cordage having four twisted pairs and to mate with a 110-type connecting block. In general, the present invention can be implemented as patch plugs designed to terminate cordage having one or more twisted pairs.

Figure 3:
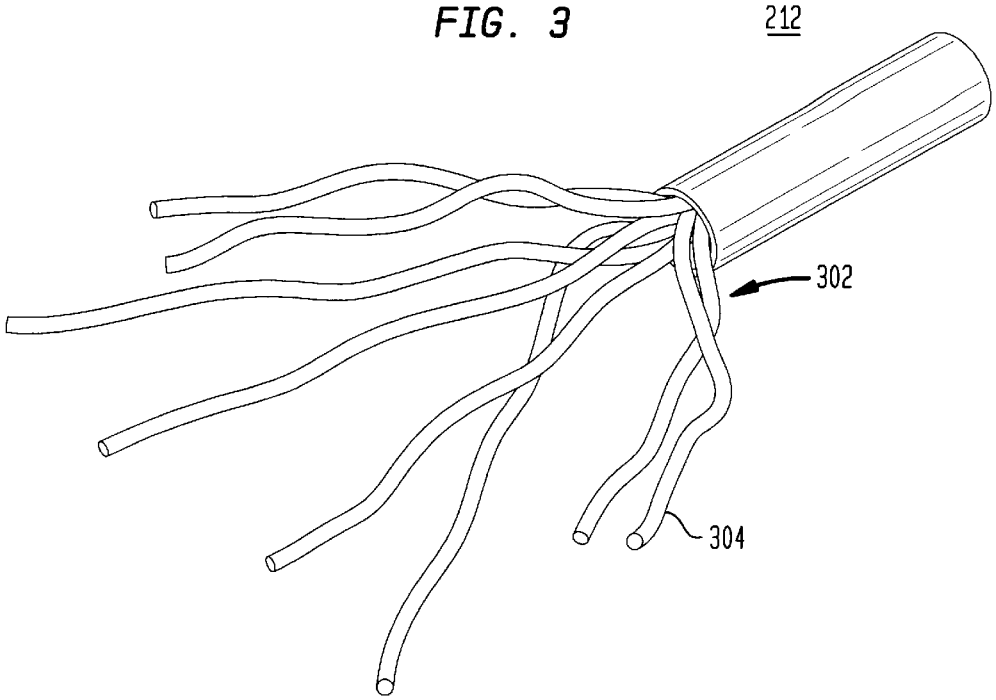
FIG. 3 shows the cordage of FIG. 2 with some of its outer insulation stripped from the end.

FIG. 3 shows cordage 212 of FIG. 2 with some of its outer insulation stripped from the end. Cordage 212 has four twisted pairs 302, with each twisted pair comprising two copper wires 304 and each twisted pair having a different specific twist rate within cordage 212.

Figure 4:
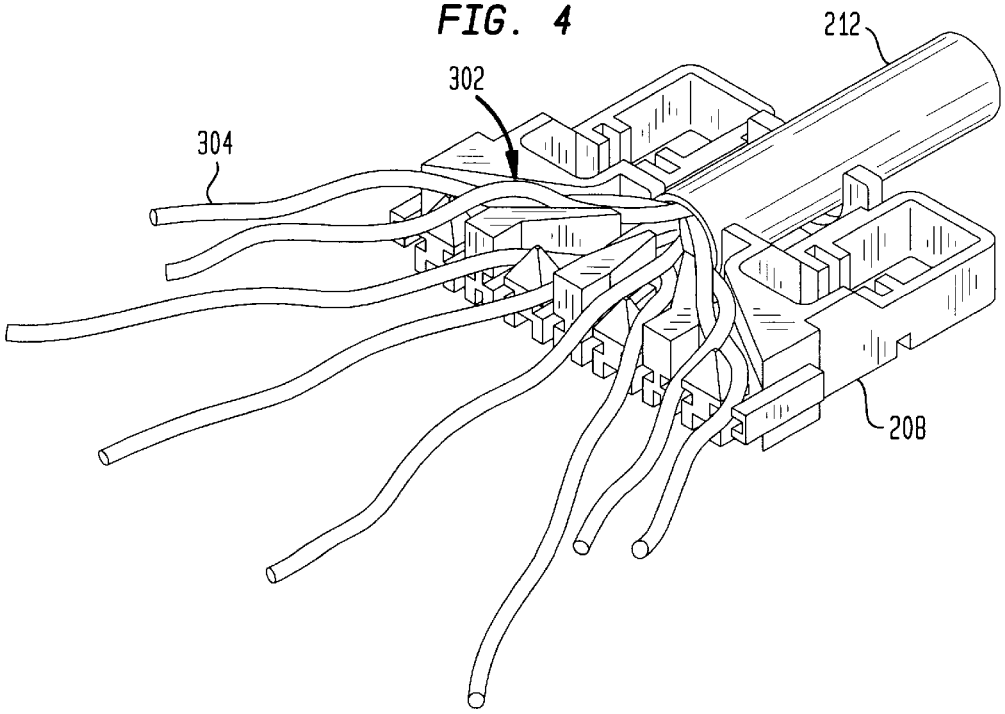
FIG. 4 shows the cordage of FIG. 2 assembled into the wire guide of FIG. 2.

FIG. 4 shows cordage 212 assembled into wire guide 208. Wire guide 208 distributes the twisted pairs and individual wires of cordage 212. In particular, each twisted pair 302 is received within a different twisted-pair channel of wire guide 208 and ultimately each wire 304 of each twisted pair 302 is received within a different wire channel of wire guide 208. Pyramidal structures at the end of each twisted-pair channel of wire guide 208 assist in the separation of the individual wires from the twisted pairs as the twisted pairs are inserted into the channels. In other embodiments, these structures may have shapes other than pyramids, such as cones or wedges. The specific twist rates for the different twisted pairs are preferably maintained when inserting the twisted pairs into the twisted-pair channels in order to limit the levels of near-end crosstalk induced between the different transmission paths.

Figure 5:
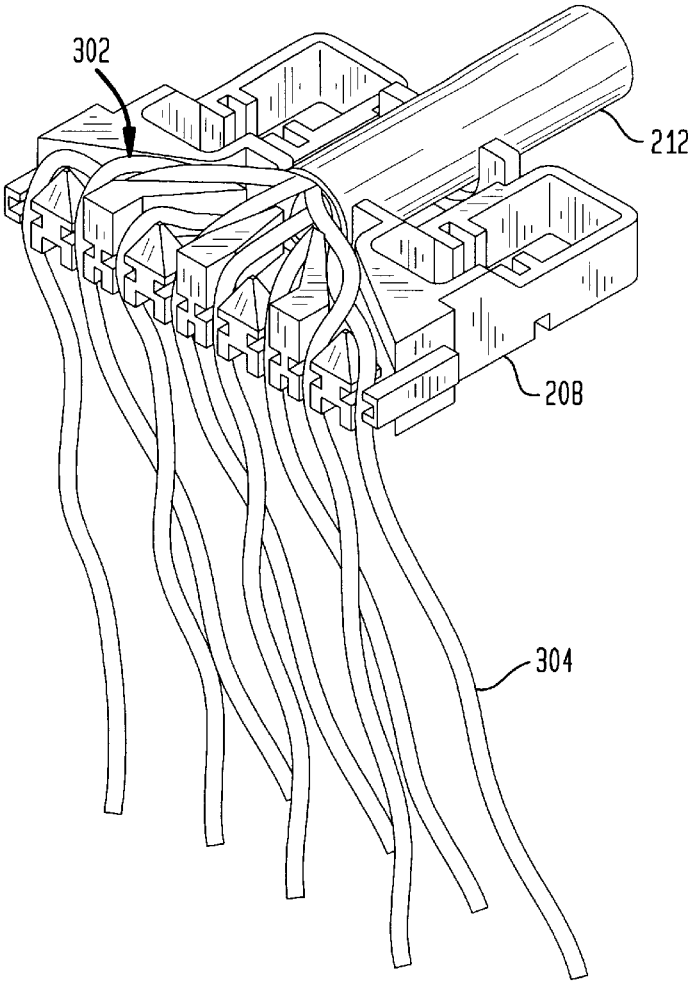
FIG. 5 shows the sub-assembly of FIG. 4 with the individual wires of the cordage positioned within IDC grooves of the wire guide.

FIG. 5 shows the sub-assembly of FIG. 4 with individual wires 304 of cordage 212 positioned within DC grooves of wire guide 208.

Figure 6:
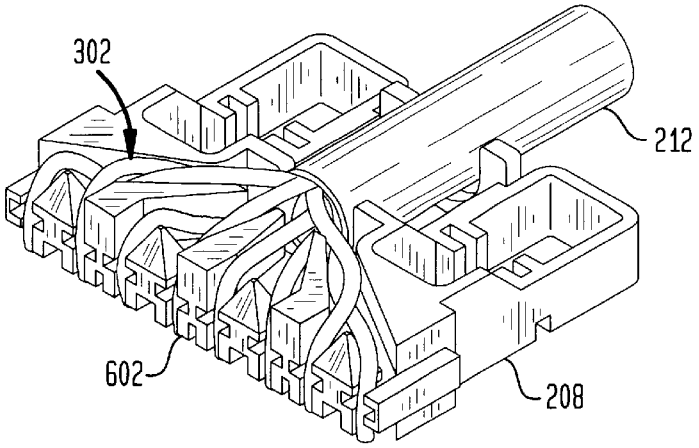
FIG. 6 shows the sub-assembly of FIG. 5 after the individual wires have been trimmed flush with the bottom of the wire guide.

FIG. 6 shows the sub-assembly of FIG. 5 after individual wires 304 have been trimmed flush with the bottom of wire guide 208. Wire guide 208 provides structures that form a trim shelf 602 that aids the wire-trimming step.

Figure 7:
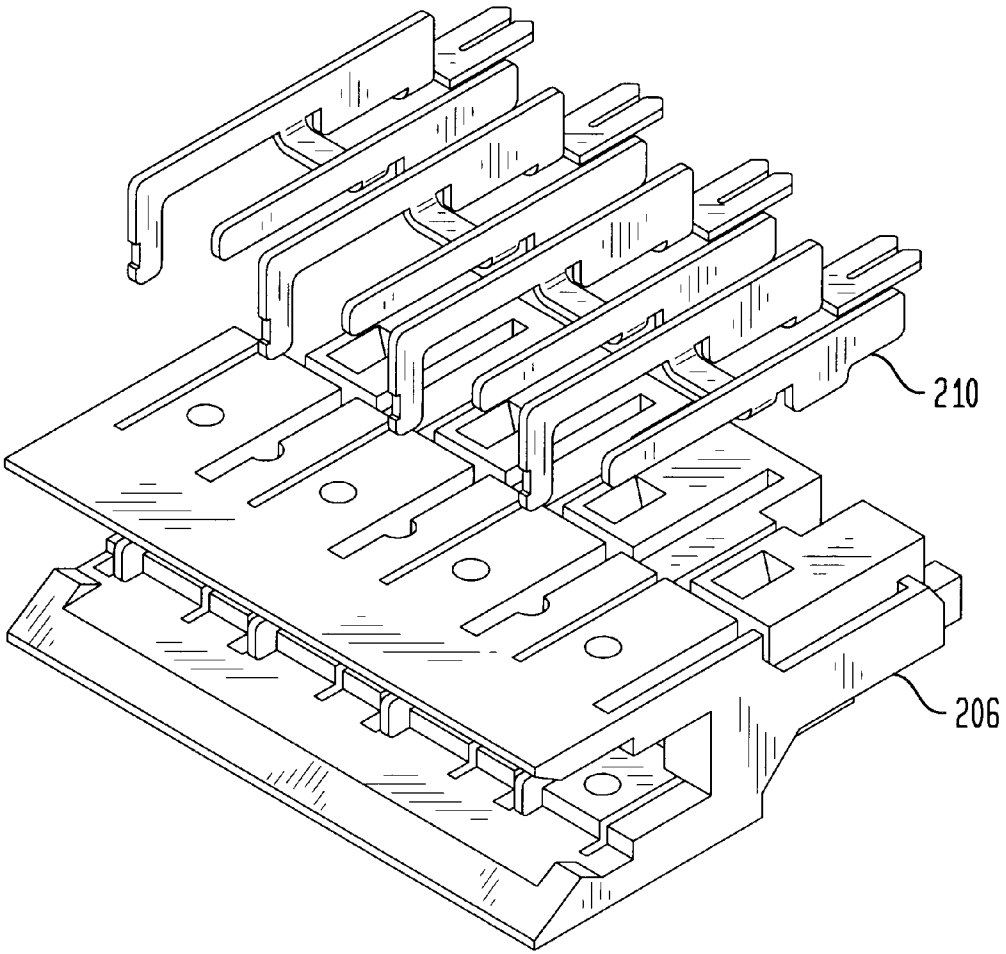
FIG. 7 shows how the four top contacts of FIG. 2 are assembled onto the top side of the contact base of FIG. 2.

FIG. 7 shows how the four top contacts 210 are assembled onto the top side of contact base 206. Contact base 206 also receives four bottom contacts (not shown) at its bottom side. According to a preferred embodiment, each TIP-RING pair comprises a top contact and a bottom contact, where the designs of the top and bottom contacts are identical. As configured for assembly, the top contact is rotated 180 degrees about its longitudinal axis with respect to the bottom contact to form the TIP-RING pair. This contact configuration is described in further detail in U.S. patent application Ser. No. 08/922,942, filed on Sep. 3, 1997 as Attorney Docket "Adriaenssens 5-11-3-2-10," the teachings of which are incorporated herein by reference.

Figure 8:
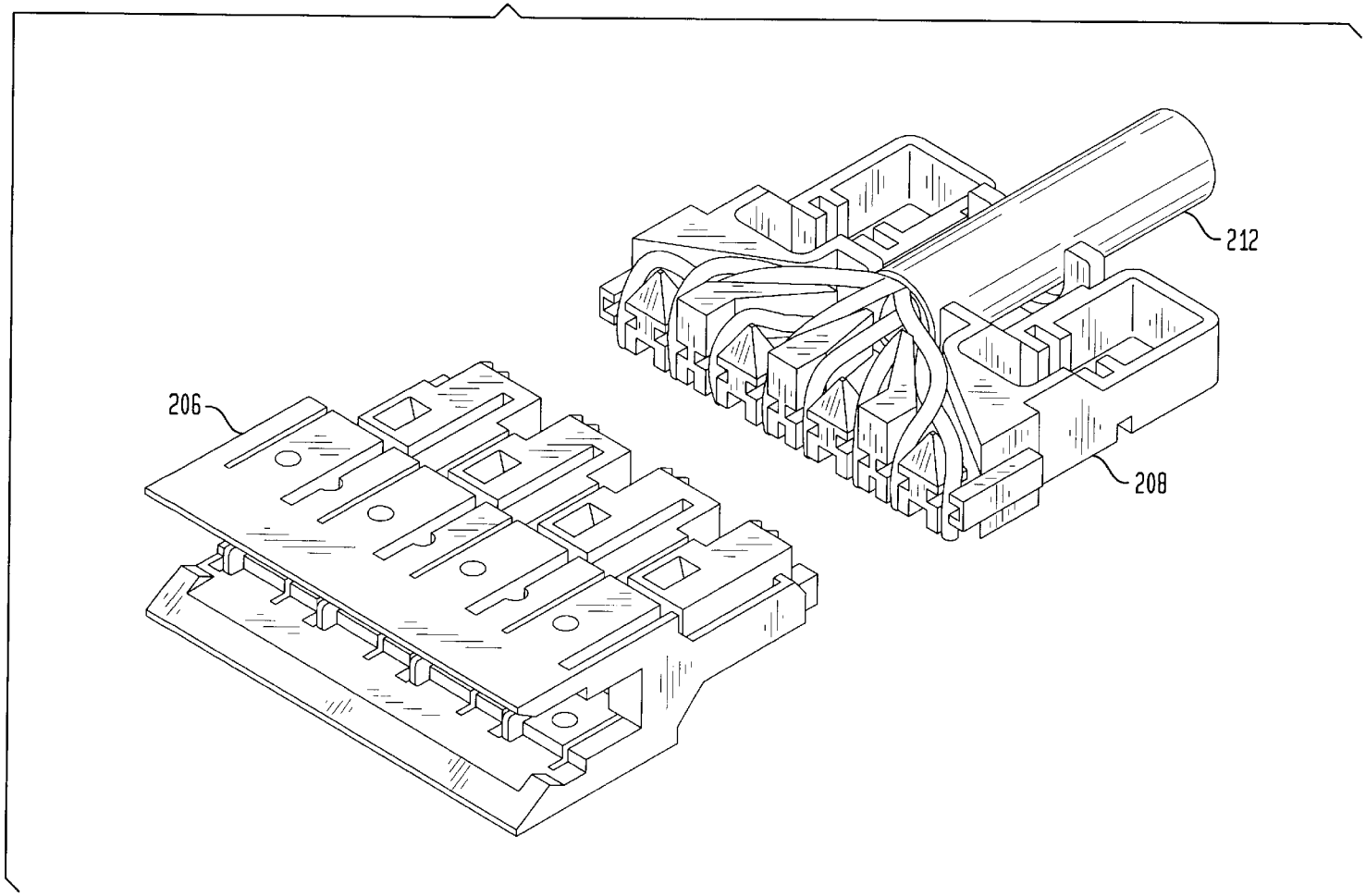
FIG. 8 shows how the contact base of FIG. 2 loaded with eight contacts is mated with the sub-assembly of FIG. 6.

FIG. 8 shows how contact base 206 loaded with eight contacts (i.e., the sub-assembly of FIG. 7) is mated with wire guide 208 loaded with cordage 212 (i.e., the sub-assembly of FIG. 6). As contact base 206 mates with wire guide 208, the IDCs of the contacts form electrical connections with the conductors of the individual wires of cordage 212 with the IDCs being received within the IDC grooves of wire guide 208 at a right angle to the individual wires.

Figure 9:
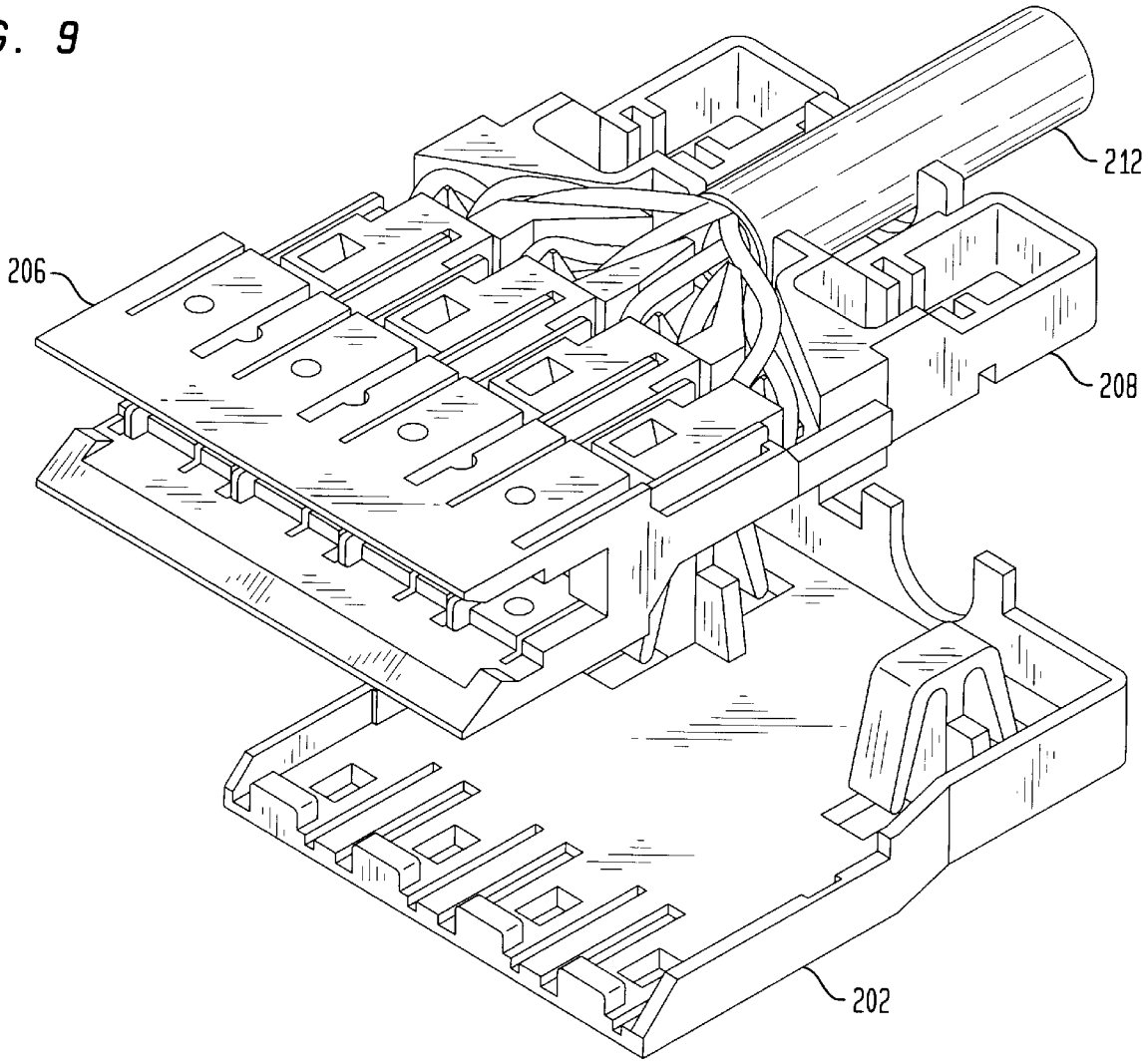
FIG. 9 shows how the bottom cover of FIG. 2 is assembled onto the sub-assembly of FIG. 8.

FIG. 9 shows how bottom cover 202 is assembled onto the sub-assembly of FIG. 8.

Figure 10:
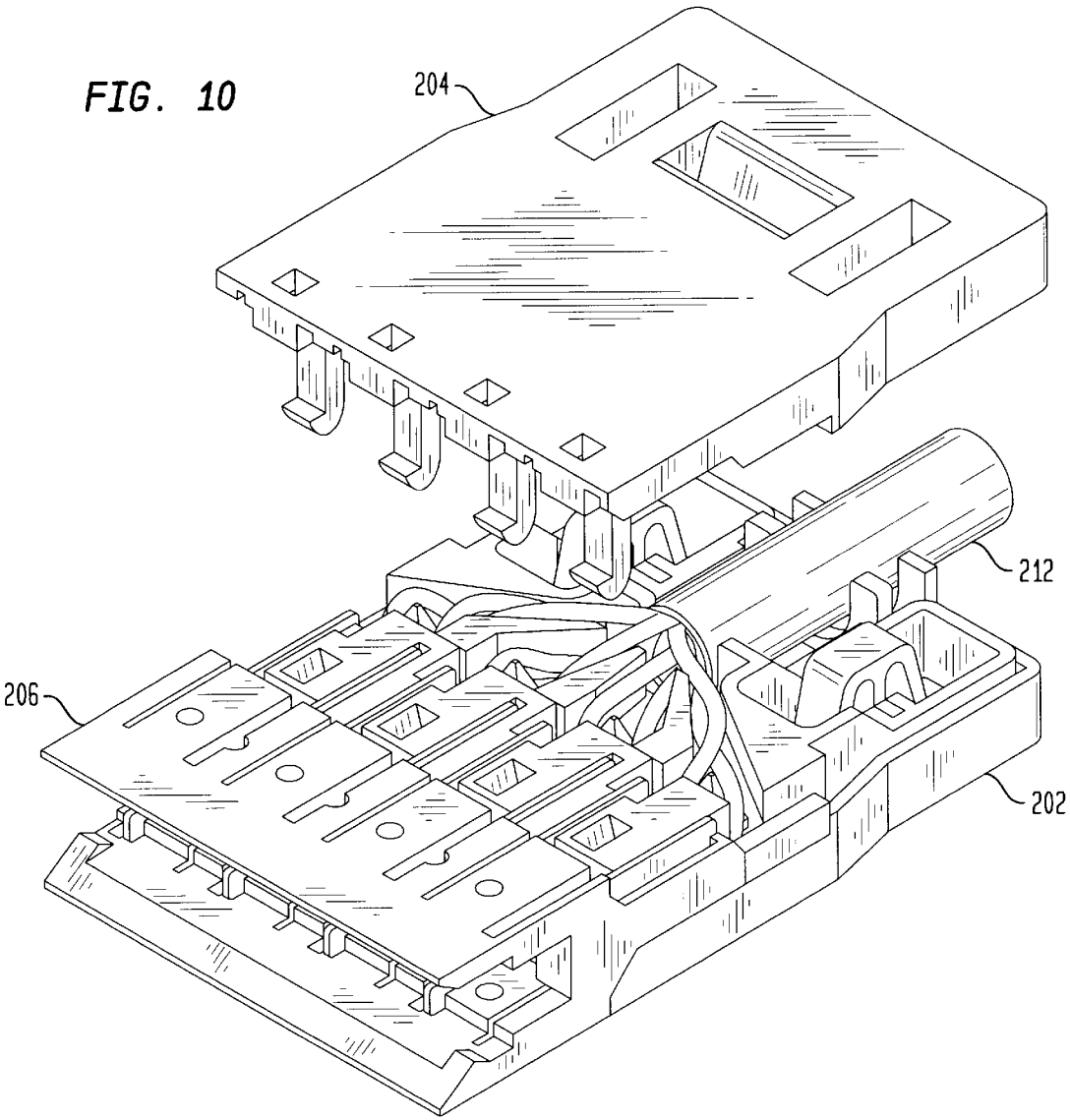
FIG. 10 shows how the top cover of FIG. 2 is assembled onto the sub-assembly of FIG. 9.

FIG. 10 shows how top cover 204 is assembled onto the sub-assembly of FIG. 9. Bottom and top covers 202 and 204 captivate the eight contacts 210 within contact base 206 and provide overall structural integrity to the patch-plug assembly.

Figure 11:
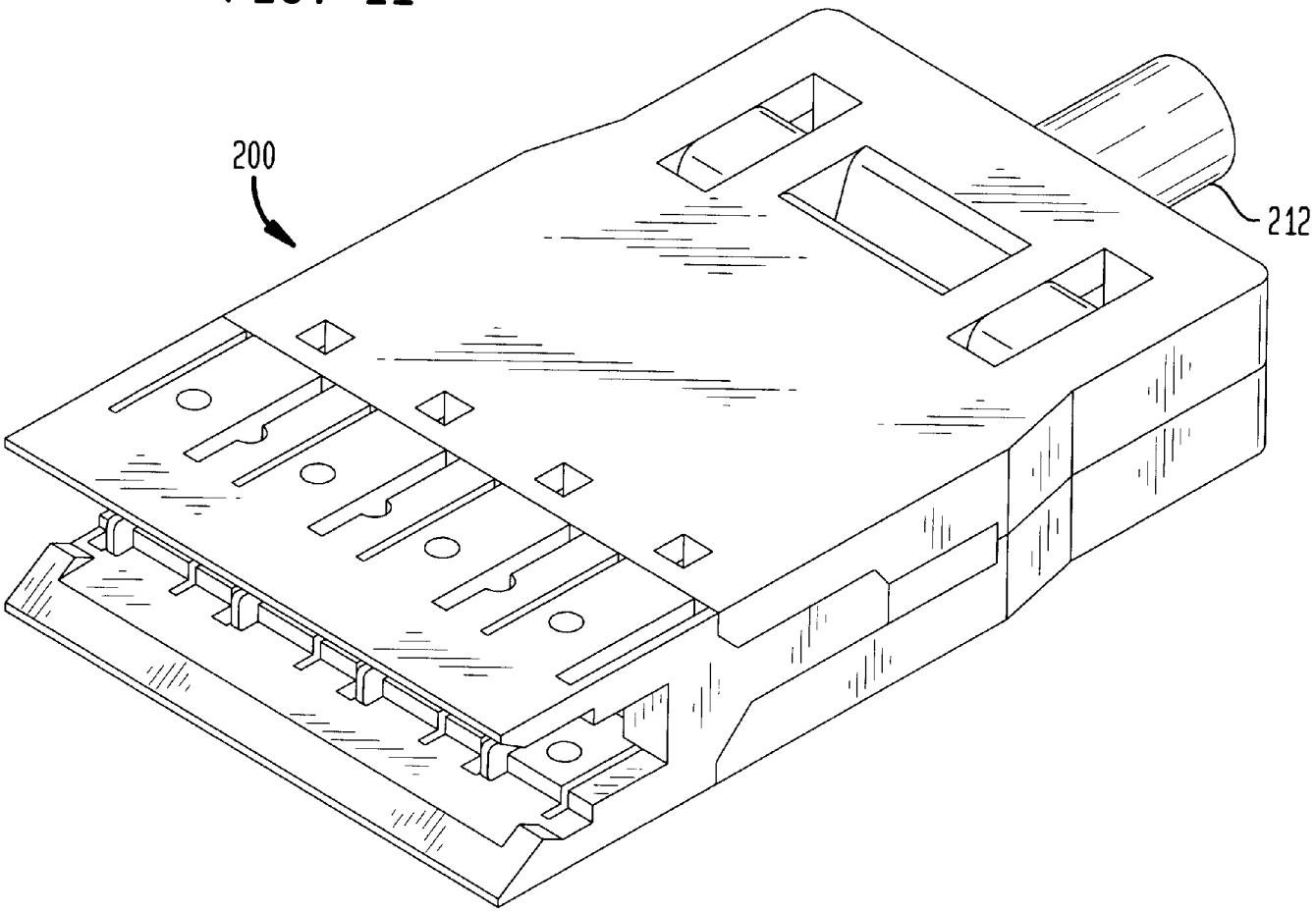
FIG. 11 shows the completed assembly of the patch cord and cordage of FIG. 2.

FIG. 11 shows the completed assembly of patch cord 200 and cordage 212.

In the embodiment shown in FIGS. 2–11, the connector of the present invention is shown as a four-piece modular assembly, not counting the individual conducting contacts. The contact base and wire guide components are separate from each other as well as from the top and bottom covers in order to enable (1) the mounting of the top and bottom contacts onto both sides of the contact base as well as (2) the connection of the IDCs to the individual wires as the contact base is mounted onto the wire guide. It will be understood that, in alternative embodiments, connectors of the present invention may have other designs. For example, the wire guide and the bottom cover could be combined into a single modular piece for a connector having a three-piece modular design.

Figure 12A:
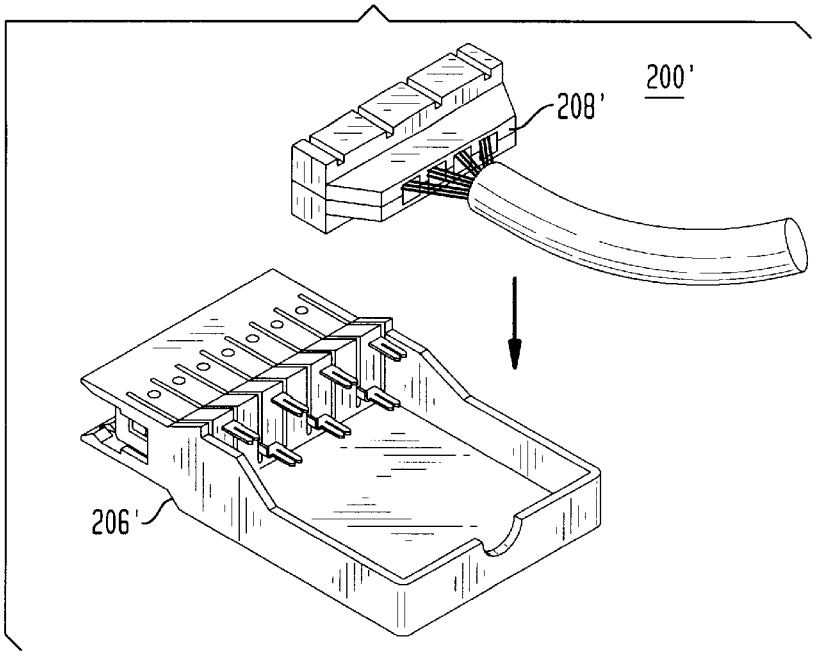
FIGS. 12A–C shows the contact base and the wire guide of a patch plug, according to another embodiment of the present invention.
Figure 12B:
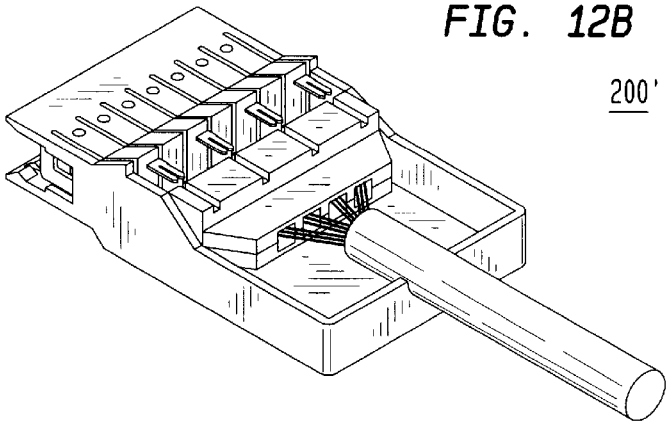
Figure 12C:
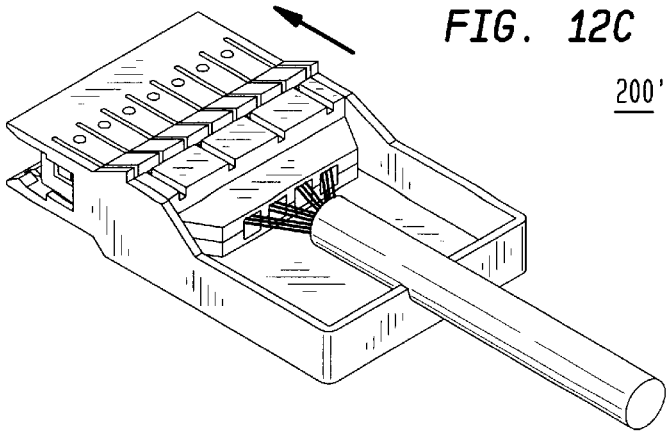

FIGS. 12A–C shows contact base 206' and wire guide 208' of a patch plug 200', according to another embodiment of the present invention. In this embodiment, strain relief for the cordage is provided by the contact base, rather than by the wire guide. As shown in FIG. 12A, when assembled into contact base 206', the IDCs of the eight contacts are arranged in two 4-contact rows. This differs from the design of patch plug 200, in which the eight IDCs are arranged in a single row, as indicated, for example, by the alignment of the IDC grooves of wire guide 208 shown in FIG. 6.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A connector for cordage having one or more twisted pairs, comprising two or more conducting contacts and a wire guide adapted to distribute the twisted pairs and individual wires of the twisted pairs from the cordage to corresponding contacts, the wire guide having two or more channels for receiving the twisted pairs and the individual wires and for controlling twist rates and routing paths of the twisted pairs and the individual wires between the cordage and the contacts, wherein the wire guide has one or more beveled structural components adapted to assist in the separation of the individual wires from the twisted pairs.

2. The connector of claim 1, further comprising a contact base adapted to receive the contacts and adapted to be mounted onto the wire guide to form a contact base/wire guide sub-assembly, and top and bottom covers adapted to be mounted onto the contact base/wire guide sub-assembly.

3. The connector of claim 1, wherein each beveled structural component has a pyramidal shape.

4. The connector of claim 2, wherein each contact has an insulation displacing contact (IDC) adapted to form an electrical connection with a corresponding wire of the cordage when the contact base is mounted onto the wire guide.

5. The connector of claim 2, wherein the contact base is adapted to receive one or more top contacts onto a top side of the contact base and one or more bottom contacts onto a bottom side of the contact base, wherein each pair of top and bottom contacts forms a TIP-RING pair.

6. A connector for cordage having one or more twisted pairs, 2 comprising:

(a) a contact base adapted to receive two or more conducting contacts;

(b) a wire guide having one or more channels for distributing the twisted pairs and individual wires of the twisted pairs from the cordage to corresponding contacts of the contact base, wherein the contact base is adapted to be mounted onto the wire guide to form a contact base/wire guide sub-assembly and the wire guide has one or more beveled structural components adapted to assist in the separation of the individual wires from the twisted pairs;

(c) a bottom cover adapted to be mounted onto a bottom side of the contact base/wire guide sub-assembly; and (d) a top cover adapted to be mounted onto a top side of the contact base/wire guide sub-assembly.

7. The connector of claim 6, wherein each contact has an IDC adapted to form an electrical connection with a corresponding wire of the cordage when the contact base is mounted onto the wire guide.

8. The connector of claim 6, wherein the contact base is adapted to receive one or more top contacts onto a top side of the contact base and one or more bottom contacts onto a bottom side of the contact base, wherein each pair of top and bottom contacts forms a TIP-RING pair.

9. The connector of claim 6, wherein each beveled structural component has a pyramidal shape.

10. A connector for cordage having one or more twisted pairs, comprising:

(a) a contact base adapted to receive one or more top contacts onto a top side of the contact base and one or more bottom contacts onto a bottom side of the contact base, wherein each pair of top and bottom contacts forms a TIP-RING pair and the top contacts have the same design as the bottom contacts;

(b) a wire guide having one or more channels for distributing the twisted pairs and individual wires of the twisted pairs from the cordage to corresponding contacts of the contact base, wherein the contact base is adapted to be mounted onto the wire guide to form a contact base/wire guide sub-assembly;

(c) a bottom cover adapted to be mounted onto a bottom side of the contact base/wire guide sub-assembly; and (d) a top cover adapted to be mounted onto a top side of the contact base/wire guide sub-assembly.

11. The connector of claim 10, wherein each contact has an IDC adapted to form an electrical connection with a corresponding wire of the cordage when the contact base is mounted onto the wire guide.

12. The connector of claim 10, wherein the wire guide has one or more structural components adapted to assist in the separation of the individual wires from the twisted pairs.

13. The connector of claim 12, wherein each structural component has a beveled shape.

14. The connector of claim 13, wherein each structural component has a pyramidal shape.

* * * * *